US006692120B2

(12) United States Patent
Yu et al.

(10) Patent No.: US 6,692,120 B2
(45) Date of Patent: Feb. 17, 2004

(54) PRESSURE REGULATION APPARATUS FOR INK RESERVOIR

(75) Inventors: Rong-Ho Yu, Hsinchu (TW); Cheng-Min Chang, Hsinchu (TW)

(73) Assignee: Microjet Technology Co., Ltd. (TW)

( * ) Notice: Subject to any disclaimer, the term of this patent is extended or adjusted under 35 U.S.C. 154(b) by 0 days.

(21) Appl. No.: 10/141,409

(22) Filed: May 8, 2002

(65) Prior Publication Data

US 2003/0043242 A1 Mar. 6, 2003

(30) Foreign Application Priority Data

Aug. 24, 2001 (TW) ..... 90120787 A

(51) Int. Cl.[7] ..... B41J 2/175
(52) U.S. Cl. ..... 347/86; 347/87
(58) Field of Search ..... 347/86, 87, 50, 347/93, 61; 430/126

(56) References Cited

U.S. PATENT DOCUMENTS 5,010,354 A * 4/1991 Cowger et al. ..... 347/87
5,409,134 A 4/1995 Cowger et al.
5,526,030 A 6/1996 Baldwin et al.
5,657,065 A * 8/1997 Lin ..... 347/93
5,965,315 A * 10/1999 Fujii et al. ..... 430/126
6,126,271 A * 10/2000 Terui ..... 347/50
6,213,598 B1 * 4/2001 Hou et al. ..... 347/86

FOREIGN PATENT DOCUMENTS

GB 2254618 * 3/1992 ..... B60R/21/16

* cited by examiner

*Primary Examiner*—Anh T. N. Vo
(74) *Attorney, Agent, or Firm*—Madson & Metcalf

(57) ABSTRACT

A pressure regulation apparatus for an ink reservoir is provided. The apparatus includes: an elastic bag mounted in the ink reservoir for freely passing an ambient air of an ambient environment outside the ink reservoir in and out the elastic bag, wherein the ink reservoir has an interior for holding an ink, and a porous filter mounted in the ink reservoir for entering the ambient air outside the ink reservoir into the interior of the ink reservoir therethrough, thereby the elastic bag and the porous filter complementarily regulating a pressure difference between the interior of the ink reservoir and the ambient environment outside the ink reservoir. By this apparatus, the pressure change within the ink reservoir is able to respond immediately for a big pressure change by the elastic bag and to regulate sensitively for a slight pressure change by the porous filter.

11 Claims, 8 Drawing Sheets

PRESSURE REGULATION APPARATUS FOR INK RESERVOIR

FIELD OF THE INVENTION

The present invention is related to a pressure regulation apparatus for an ink reservoir, and more particularly, to a pressure regulation apparatus for an ink reservoir, which applies an elastic bag and a porous filter for complementarily regulating the back pressure within the ink reservoir to reach a steady balance of a pressure difference within and outside the ink reservoir.

BACKGROUND OF THE INVENTION

Nowadays, the ink-jet printer has become a necessary accessory printing equipment of a computer in modern information time. Typically, there are two mechanisms for ejecting drops of the ink from the ink reservoir. One is the piezoelectric pressure wave type, and the other is the thermal bubble type. No matter which type is used, the pressure must be controlled from the interior of the ink reservoir so that the ink reservoir of an ink-jet printer is under the best usage without ink leakage or ink blockage. That is, the back pressure (which means the partial vacuum within the ink reservoir or the pressure within the ink reservoir is slightly smaller than the atmospheric pressure) within the interior of the ink reservoir has to be maintained at a proper and steady condition. Generally, the ink reservoir of the ink-jet printer can be divided into two types. One is the ink reservoir for holding the ink only, and the other is the ink reservoir with a printing chip. The former must be co-operated with a print head mounted in the ink-jet printer, which has a printing chip. The latter combines the ink reservoir and the printing chip together, which is called inkjet head (ink-jet pen). Nevertheless, it is to be understood that the description below is limited to neither of the two above types. On the contrary, it is intended to cover a pressure regulation apparatus for an ink reservoir, which can be used in every kind of ink reservoir when the pressure needs to be regulated.

U.S. Pat. No. 5,409,134 disclosed a pressure-sensitive accumulator for an ink-jet pen, as shown in FIG. 1. The accumulator includes an expandable bag 11 which is mounted attachably to a spring 12. The upwardly projecting boss 131 is mounted on the cap 13 of the ink reservoir 1 so that the interior of the bag 11 is in communication with the ambient air outside the ink reservoir 1 through the central duct 132 which passes through the projecting boss 131. When the ink reservoir 1 is used for printing, the space of air increases (and hence, the back pressure increases) as the ink is consumed. The bag 11 expands as a result of the back pressure increase. Expansion of the bag 11 deflects the spring 12. The spring 12 bent originally will tend to be straight and accumulate the recovery strength. Meanwhile, the ambient air outside the ink reservoir 1 enters the interior of the bag 11 through the projecting boss 131 so that the back pressure within the ink reservoir 1 and the outside ambient pressure reach a proper balance. Similarly, if some factors result in the ambient pressure outside the ink reservoir 1 smaller than the pressure within the ink reservoir 1, the recovery strength of the spring 12 will make itself back to its original bent shape. The recovery strength of the spring 12 tends to contract the bag 11. Therefore, the bag 12 volume decreases and the internal air within the ink reservoir 1 is squeezed out of the ink reservoir 1 so that the pressure within and outside the ink reservoir 1 can reach a balance.

In the operation of air regulation to maintain the pressure balance, a relative adjustment of the back pressure change within the ink reservoir 1 is accomplished by the relationship between the elasticity of the spring 12 and the expansion of the bag 11 mounted attachably thereto. Since the interior of the bag 11 has a big air capacity, the air capacity change generated by a bigger pressure difference is allowed. However, the spring 12 itself has a basic pressure requisite upon deformation, so it lacks the sensitivity of the pressure difference if the pressure difference is not big enough. On the other hand, in the respect of manufacturing technology, it is difficult to control the coefficient of elasticity of the spring 12 and the capacity change of the bag 11 accurately. It is easy to cause the spring 12 to be bent or relaxed while the pressure difference is just generated. However, the flexure and the deformation of the spring 12, which are caused by the pressure difference, will be slow down if the spring 12 has been bent to a certain extent. In addition, the spring 12 and the bag 11 might not have a good attachment, and we must consider the possible malfunction upon the assembly of the projecting boss 131. Therefore, the apparatus established according to this pressure regulation method might have a poor response to the pressure change after being used for a period of time. It might also cause a lower product pass rate when manufacturing.

Additionally, U.S. Pat. No. 5,526,030 disclosed another apparatus of the pressure regulation, as shown in FIG. 2. An opening 21 is mounted at the bottom of the ink reservoir 2. A sphere 22 is mounted concentrically within the opening 21. The sphere 22 is maintained within the opening 21 by a number of raised crush ribs 23 formed around the interior of the opening 21. The outside diameter of the sphere 22 is smaller than the inside diameter of the opening 21 to define an annular orifice 24 (as shown in FIG. 3). Under the opening 21, an inlet labyrinth 25 is provided, which is a path having a semicircular cross section between the hole 27 and the opening 21. The whole length of the inlet labyrinth 25 is sealed from both the ambient air and the reservoir by a cover 26. The proximal end of the inlet labyrinth 25 opens to the opening 21 and the distal end opens to the ambient air through a hole 27 mounted on the cover 26. When the pressure within the ink reservoir 2 is lower than that of the outside, the ambient air passes through the inlet labyrinth 25 and the annular orifice 24 to enter the ink reservoir 2 to balance the pressure within and outside the ink reservoir 2. When the pressure within the ink reservoir 2 is higher than that of the outside, the ink enters the inlet labyrinth 25 at the bottom of the ink reservoir 2 through the annular orifice 24 and is stored within the inlet labyrinth 25 temporarily. Nevertheless, when the pressure within the ink reservoir 2 returns to the normal, the ink stored within the inlet labyrinth 25 temporarily will reenter the ink reservoir 2 by the pressure difference and the capillarity.

This pressure regulation method is simpler than the former method which uses a bag and a spring. However, since the inlet labyrinth 25 at the bottom of the ink reservoir 2 can only keep a very small amount of ink, the inlet labyrinth 25 might not be able to completely keep the excessive ink if the pressure difference within and outside the ink reservoir 2 is too large. Therefore, the phenomenon of ink leakage, which means that the ink flows out from the ink reservoir 2 through the annular orifice 24, will happen. On the other hand, the annular orifice 24 formed by the relative cooperation between the raised crush ribs 23 and the opening 21 must have a good accuracy, or the capillarity can not proceed smoothly. Accordingly, the product pass rate is reduced.

In view of how important the pressure regulation is and its serious affect to the smoothly ejecting drops of ink from the ink reservoir, a pressure regulation apparatus for an ink reservoir is provided. The ink reservoir described in the present invention covers both the type of ink reservoir for only holding ink and the type of ink reservoir with a printing chip.

SUMMARY OF THE INVENTION

The main purpose of the present invention is to provide a pressure regulation apparatus for an ink reservoir, which applies the elastic bag and the porous filter for complementarily regulating the back pressure within the ink reservoir to obtain a steady and balanceable pressure difference within and outside the ink reservoir.

It is another object of the present invention to provide a pressure regulation apparatus for an ink reservoir, which includes the elastic bag and the porous filter for complementarily regulating the back pressure within the ink reservoir to obtain a steady and balanceable pressure difference within and outside the ink reservoir.

The characteristic of the present invention is that the pressure regulation apparatus for an ink reservoir uses both the elastic bag to respond immediately for a big pressure change and the porous filter to regulate sensitively for a slight pressure change. Therefore, the pressure difference within and outside the ink reservoir can be maintained within a steady range.

According to the present invention, a pressure regulation apparatus for an ink reservoir, comprises: an elastic bag mounted in the ink reservoir for freely passing an ambient air of an ambient environment outside the ink reservoir in and out the elastic bag, wherein the ink reservoir has an interior for holding an ink; and a porous filter mounted in the ink reservoir for entering the ambient air outside the ink reservoir into the interior of the ink reservoir therethrough, thereby the elastic bag and the porous filter complementarily regulating a pressure difference between the interior of the ink reservoir and the ambient environment outside the ink reservoir.

In accordance with the present invention, the elastic bag has an interior in communication with the ambient air outside the ink reservoir having a cover body through an opening orifice mounted on the cover body of the ink reservoir so that the ambient air outside the ink reservoir freely passes in and out the elastic bag.

Preferably, the filter is mounted inside a positioning hole at a bottom of the ink reservoir.

Preferably, the positioning hole defines a blocking flange radially protruded toward a central axis of the positioning hole, a specific bore diameter and a specific mold drawing angle with a specific taper for the filter to be positioned thereinside.

Preferably, a proportion between a biggest volume of the elastic bag when expanded completely and a total volume of the ink reservoir ranges from 10% to 60%.

Preferably, the elastic bag is made of a polymer with a yield strength ranged from 5600 to 6400 kg/cm$^2$.

Preferably, the filter is made of a material having plural fibers aligned in an axial direction.

Preferably, the filter is made of polymers of polypropylene and polythene.

Preferably, the filter has a density ranged from 0.01 to 0.8 g/cm$^3$.

Preferably, a flowing channel between the filter and the ambient air outside the ink reservoir is provided for passing by and entering the ambient air outside the ink reservoir into the interior of the ink reservoir through the filter, and holding the ink therein temporarily.

Preferably, flowing channel has an end corresponding to the positioning hole and communicating with an aperture on a cover board covering completely the flowing channel, thereby the ambient air outside the ink reservoir passing by the aperture to the filter, and entering the interior of the ink reservoir.

Preferably, the ink reservoir has a print head using a thermal bubble system for ejecting the ink, and a printing chip mounted thereunder.

According to another aspect of the present invention, a pressure regulation apparatus for an ink reservoir having a printing chip mounted thereunder and an interior for holding an ink, comprises: an elastic bag provided in the ink reservoir and having an interior in communication with an ambient air of an ambient environment outside the ink reservoir through an opening orifice mounted on a cover body of the ink reservoir so that the ambient air outside the ink reservoir freely passes in and out the bag; and a porous filter for entering the ambient air outside the ink reservoir into the interior of the ink reservoir therethrough, thereby the elastic bag and the porous filter complementarily regulating a pressure difference between the interior of the ink reservoir and the ambient environment outside the ink reservoir.

The foregoing and other features and advantages of the present invention will be more clearly understood through the following descriptions with reference to the drawings, wherein:

DETAILED DESCRIPTION OF THE PREFERRED EMBODIMENT

Figure 1:
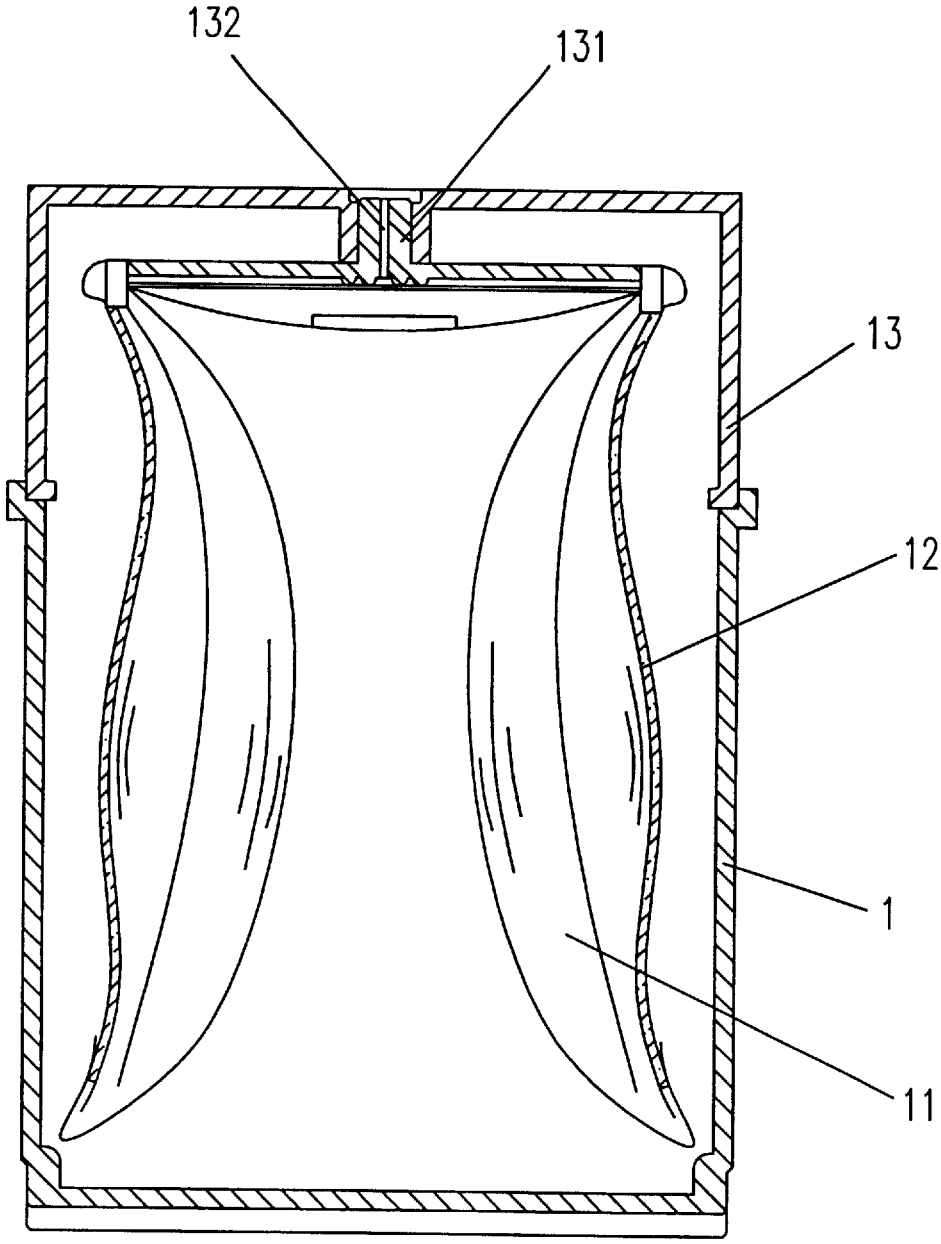
Fig. 1 (PRIOR ART)
FIG. 1 is a schematic diagram illustrating the accumulator shown in U.S. Pat. No. 5,409,134, which uses a bag and a spring to regulate the pressure within the ink reservoir.
Figure 2:
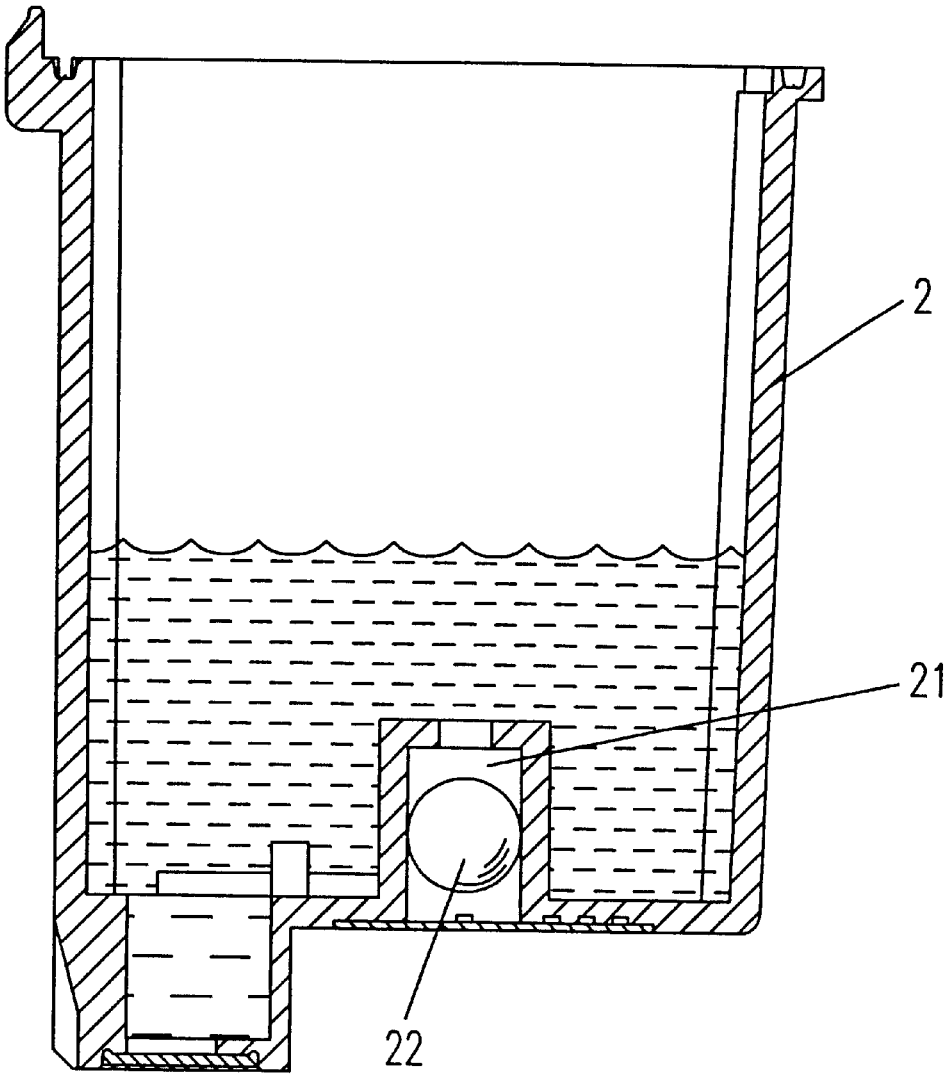
Fig. 2 (PRIOR ART)
FIG. 2 is a sectional view illustrating the apparatus shown in U.S. Pat. No. 5,526,030, which uses a sphere and an inlet labyrinth to regulate the pressure within the ink reservoir.
Figure 3:
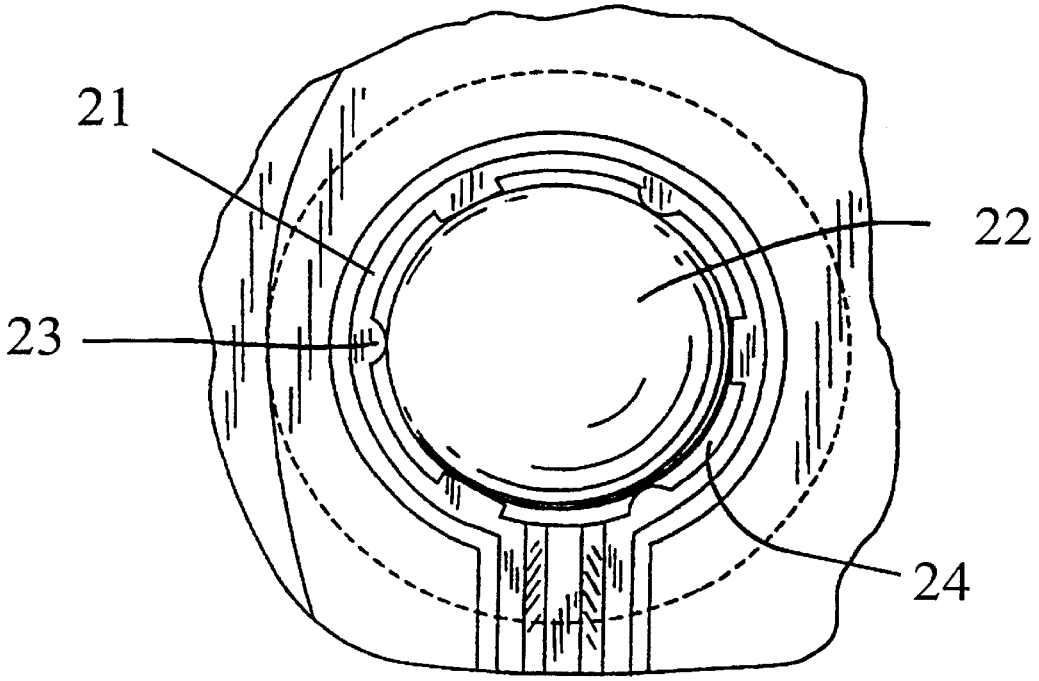
Fig. 3 (Prior Art)
FIG. 3 is a diagram illustrating the annular orifice between the sphere and the opening according to FIG. 2.
Figure 4:
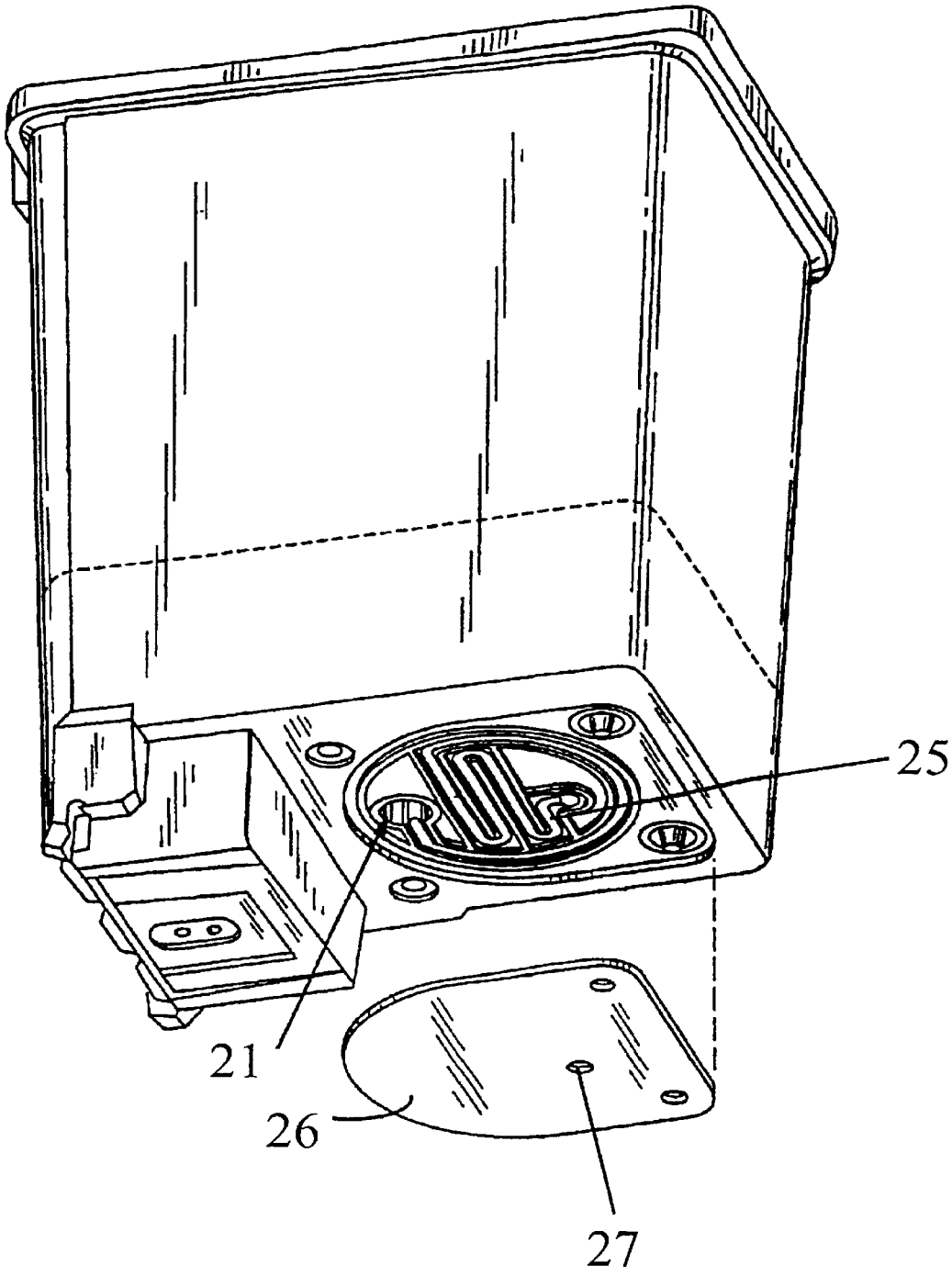
Fig. 4 (Prior Art)
FIG. 4 is a diagram illustrating the inlet labyrinth at the bottom of the ink reservoir according to FIG. 2.
Figure 5:
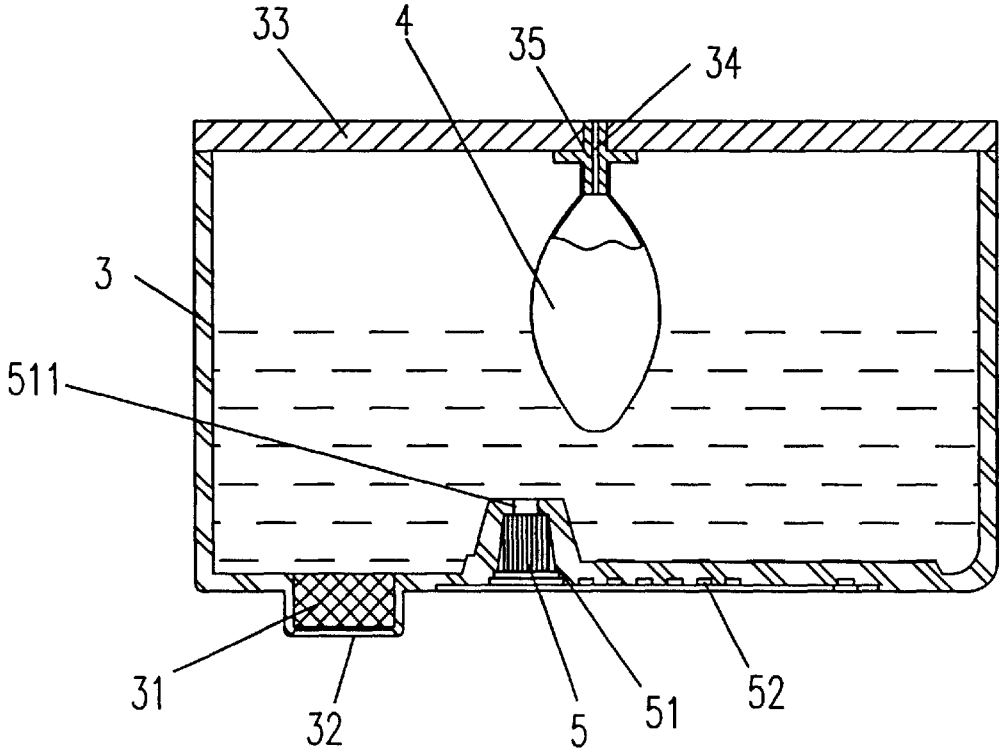
FIG. 5. is a sectional view illustrating the ink reservoir without a printing chip mounted thereunder for regulating the pressure within the ink reservoir according to a preferred embodiment of the present invention.

The present invention will now described more specifically with reference to the following embodiments. Please refer to FIG. 5. FIG. 5 is a sectional view illustrating the ink reservoir without a printing chip mounted thereunder for regulating the pressure within the ink reservoir according to a preferred embodiment of the present invention. The ink reservoir is set up in an ink-jet printer which has a printing chip on its print head for ejecting drops of ink. The ink within the ink reservoir 3 flows through the filter net 31, which is used for filtering the ink, to the ink supply opening 32 for ink supply. An elastic bag 4 with a proper elasticity is mounted inside the ink reservoir 3. An opening orifice 34 is mounted on the cover body 33 of the ink reservoir 3. The interior of the elastic bag 4 is in communication with the ambient air outside the ink reservoir 3 through the opening orifice 34 so that the ambient air outside the ink reservoir 3 freely passes in and out the elastic bag 4. The opening orifice 34 is fixedly mounted within the opening base 35 on the cover body 33. The elastic bag 4 is fixedly disposed on the opening base 35 too.

Figure 6:
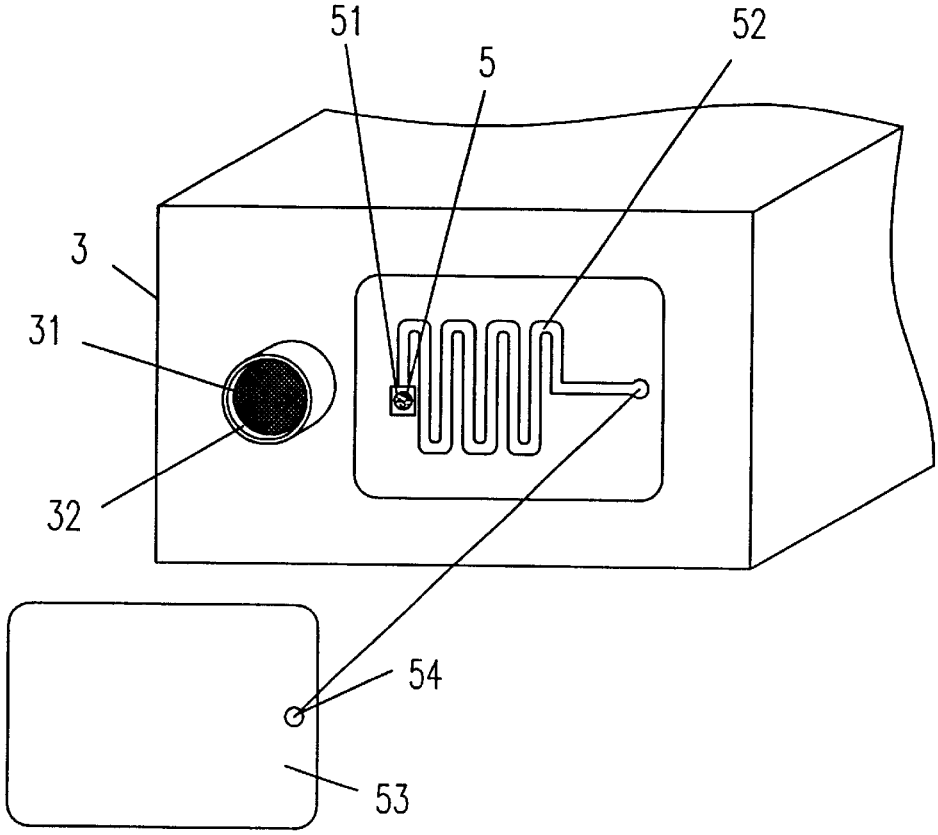
FIG. 6 is a diagram illustrating the flowing channel at the bottom of the ink reservoir according to a preferred embodiment of the present invention.

The porous filter 5 is provided inside the ink reservoir 3, which is mounted inside the positioning hole 51 at the bottom of the ink reservoir 3. The positioning hole 51 is in communication with the ambient air outside the ink reservoir 3. The positioning hole 51 defines a blocking flange 511 radially protruded toward a central axis of the positioning hole 51. It also defines a specific bore diameter and a specific mold drawing angle with a specific taper for the porous filter 5 to be positioned thereinside, and therefore a tightness can be maintained for avoiding filter 5 escape therefrom. Under the positioning hole 51, which communicates with the bottom of the ink reservoir 3, a circuitous flowing channel 52 is provided, as shown in FIG. 6. The flowing channel 52 has an end corresponding to the positioning hole 51 and communicating with the aperture 54 on the cover board 53. The cover board 53 completely covers the flowing channel 52. Therefore, the ambient air outside the ink reservoir 3 passes by the aperture 54 to the filter 5 and enters into the interior of the ink reservoir 3. The circuitous way of the flowing channel 52 can be changed according to requirements, which needs not to be limited to a certain circuitous shape or space arrangement.

The principle of pressure regulation apparatus according to the preferred embodiment of the present invention is described below. When the back pressure within the ink reservoir 3 increases because of the decreased ink while printing or because of some other factors, the ambient air outside the ink reservoir 3 will enter the elastic bag 4 to compensate the increased internal space volume caused by the consumed ink. Meanwhile, the elastic bag 4 will accumulate its recovery strength. When the back pressure within the ink reservoir 3 decreases because of some factors (whenever the pressure is higher than before), the volume of the elastic bag 4 will decrease due to the sum of the originally accumulated recovery strength and the back pressure within the ink reservoir 3 is bigger than the atmospheric pressure outside the ink reservoir 3. Therefore, the air inside the elastic bag 4 will be squeezed out of the ink reservoir 3 through the opening orifice 34, so that the pressure within and outside the ink reservoir 3 can reach a steady balance.

In the operation of air regulation to maintain the pressure balance, since the elastic bag 4 has a bigger internal space volume, the air volume change caused by a bigger pressure difference is allowed. Nevertheless, the relationship between the deformation of the bag 4 itself and the recovery strength, and the pressure regulation sensitivity affected by the relationship between the volume of the elastic bag 4 and the changeable volume responsive to the pressure difference within and outside the ink reservoir 3, will be able to be compensated by the porous filter 5 inside the ink reservoir 3. The porous filter 5 has a characteristic of capillarity because of its porosity. Under the circumstances that the pressure difference within and outside the ink reservoir 3 has not reached the basic point to cause the deformation of the elastic bag 4, or the elastic bag 4 has reached the extreme expansion, or whenever the unstable pressure difference happens, the ambient air will enter inside the ink reservoir 3 through the filter 5 when the internal pressure is lower than the pressure outside the ink reservoir 3. Thus, the pressure difference within and outside the ink reservoir 3 can reach a predictable balance. When the internal pressure is higher than the pressure outside the ink reservoir 3, the ink will flow through the porous filter 5 to the flowing channel 52 and be temporarily stored therein at the bottom of the ink reservoir 3. However, when the pressure within the ink reservoir 3 drops back, the ink stored in the flowing channel 52 will flow back and reenter the ink reservoir 3 by the pressure difference and capillary action. The density of the filter 5 itself will affect the entering and the passing through of the ambient air. If a porous filter 5 with a higher density is used, the ambient air outside the ink reservoir 3 can not enter inside the ink reservoir 3 easily to compensate the lost air. Similarly, the ink within the ink reservoir 3 can not flow through the porous filter 5 easily to the flowing channel 52 and be temporarily stored therein.

If a porous filter 5 with a lower density is used, the ambient air outside the ink reservoir 3 is able to enter inside the ink reservoir 3 easily to compensate the lost air. The back pressure within the ink reservoir 3 will be too low and the ink leakage will be caused. However, the effect to the back pressure within the ink reservoir 3, caused by the difficult control of the density of the porous filter 5 can just be compensated by the elastic bag 4. Therefore, a close interaction is formed between the elastic bag 4 and the porous filter 5. While the pressure difference within and outside the ink reservoir 3 is starting to change, the volume of the elastic bag 4 will be changed by the ambient air passing in and out, and the filter 5 will provide capillary action to compensate the lost air. These two mechanisms are complementary to each other in harmony to regulate the pressure within the ink reservoir 3. In such way, the pressure change within the ink reservoir 3 is able to respond immediately for a big pressure change by the elastic bag 4 and to regulate sensitively for a slight pressure change by the porous filter 5. The pressure difference within and outside the ink reservoir 3 is therefore regulated within a preferred balance range.

The porous filter 5 itself has a good ability for holding the ink. Except by the pressure difference within and outside the ink reservoir 3, the ink can hardly pass through the small holes of the filter 5 into the inside of the ink reservoir 3 to change the back pressure therein even when the ink reservoir is disposed up side down.

The material of the elastic bag 4 is selected according to the environment involved. Generally, a proportion between a biggest volume of the elastic bag when expanded completely and the total volume of the ink reservoir ranges from 10% to 60%. For the sake of the elasticity, the elastic bag is made of a polymer such as latex, silica gel, and rubber, with a yield strength ranged from 5600 to 6400 $kg/cm^2$.

Figure 7:
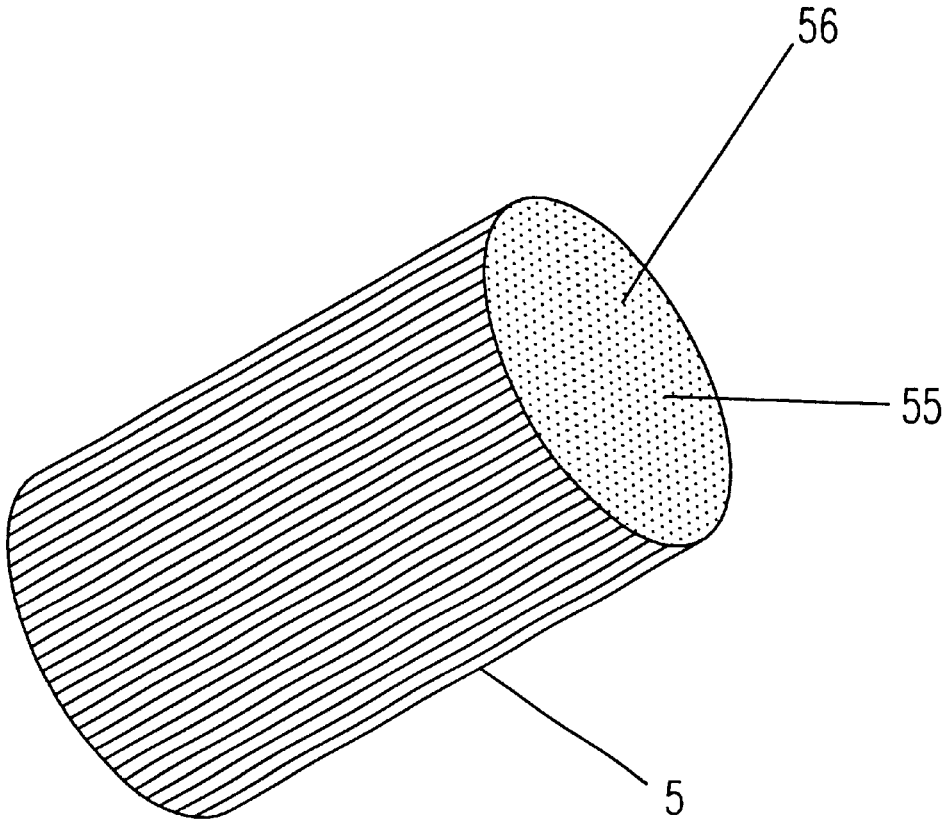
FIG. 7 is a diagram illustrating the structure of the filter according to a preferred embodiment of the present invention.

The material of the porous filter 5 is selected according to the elastic bag 4 used The porous filter 5 is made of a material having plural fibers 55 aligned in the axial direction, as shown in FIG. 7. The diameter of the sectional area is ranged from 2 mm to 9 mm. The filter 5 is made of polymers of polypropylene and polythene, which have the porous characteristic. The small holes 56 are generated because of the gap among the plural fibers 55. The plural fibers 55 of the porous filter 5 have a density ranged from 0.01 to 0.8 $g/cm^3$.

Figure 8:
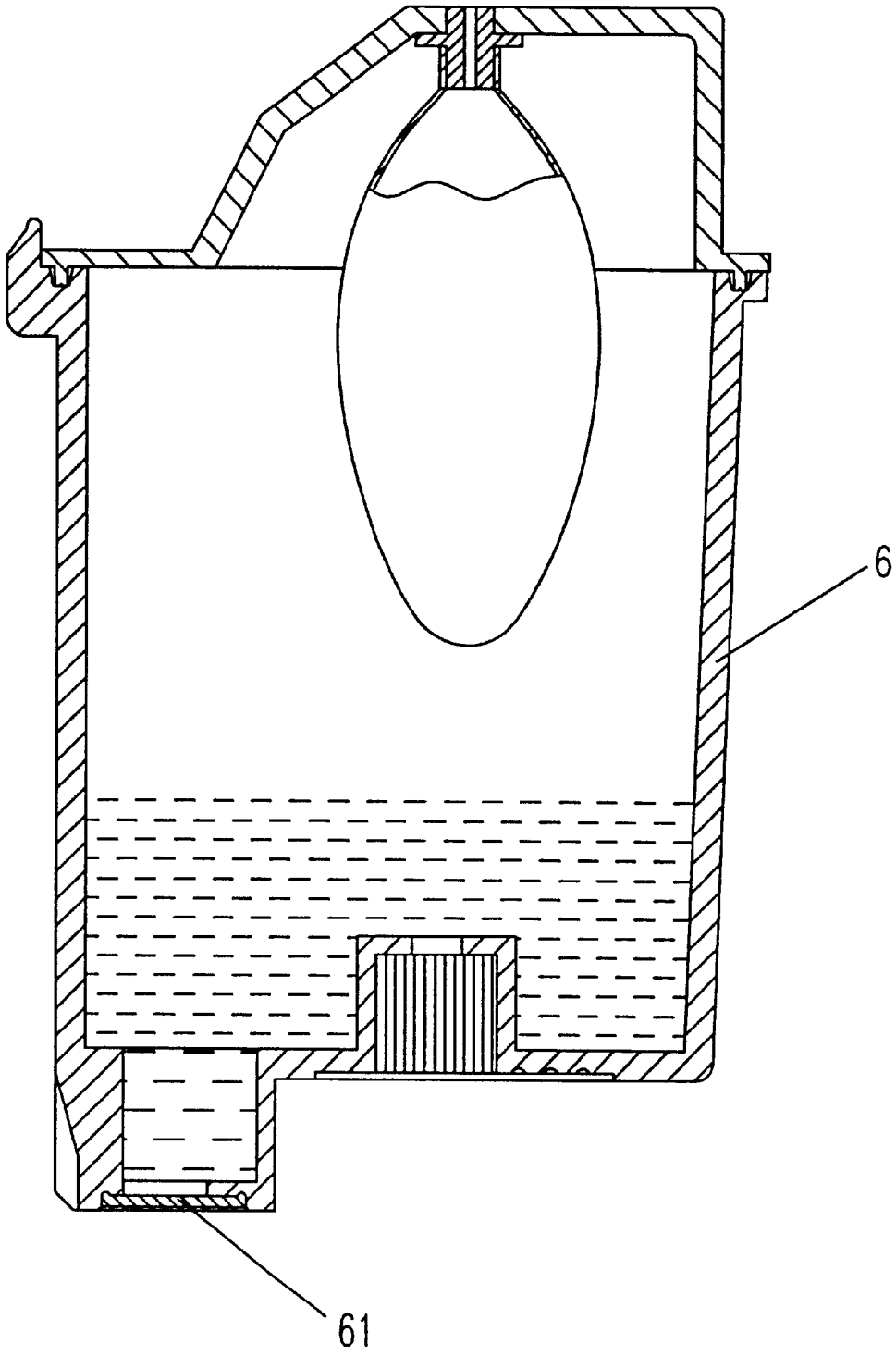
FIG. 8 is a diagram illustrating the apparatus applied to the thermal bubble type print head according to a preferred embodiment of the present invention.

The present invention uses the elastic bag 4 and the porous filter 5, which form a close interaction between each other, so that the pressure within the ink reservoir 3 can be regulated most properly by the mutual compensation. Not only the complicated and uncontrollable device manufacturing preciseness and the inconvenient assembly are prevented, but also the sensitivity of pressure regulation is largely increased. Although the ink reservoir with a printing chip in the thermal bubble type is not described in the embodiment of the present invention, however, only person skilled in the art can easily apply thereto the technology in the filed of the ink reservoir in the piezoelectric pressure wave type or the ink reservoir with a printing chip called ink-jet head. As shown in FIG. 8, when the ink reservoir with a printing chip in the thermal bubble type is used, the only difference is that a printing chip 61 is mounted under the ink reservoir 6. The apparatus for pressure regulation are similar to those of the above-described embodiment of the present invention, and it is therefore not to be described repeatedly.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A pressure regulation apparatus for an ink reservoir, comprising:

an elastic bag mounted in said ink reservoir for freely passing an ambient air of an ambient environment outside said ink reservoir in and out said elastic bag, wherein said ink reservoir has an interior for holding an ink;

a porous filter mounted in said ink reservoir for entering said ambient air outside said ink reservoir into said interior of said ink reservoir therethrough, wherein said porous filter is made of a material having plural fibers aligned in an axial direction; and a flowing channel formed between said porous filter and said ambient air outside said ink reservoir for passing by and entering said ambient air outside said ink reservoir into said interior of said ink reservoir through said porous filter and holding said ink therein temporarily, thereby said elastic bag and said porous filter complementarily regulating a pressure difference between said interior of said ink reservoir and said ambient environment outside said ink reservoir.

2. The pressure regulation apparatus according to claim 1, wherein said elastic bag has an interior in communication with said ambient air outside said ink reservoir having a cover body through an opening orifice mounted on said cover body of said ink reservoir so that said ambient air outside said ink reservoir freely passes in and out said elastic bag.

3. The pressure regulation apparatus according to claim 1, wherein said porous filter is mounted inside a positioning hole at a bottom of said ink reservoir.

4. The pressure regulation apparatus according to claim 3, wherein said positioning hole defines a blocking flange radially protruded toward a central axis of said positioning hole, a specific bore diameter and a specific mold drawing angle with a specific taper for said filter to be positioned thereinside.

5. The pressure regulation apparatus according to claim 1, wherein a proportion between a biggest volume of said elastic bag when expanded completely and a total volume of said ink reservoir ranges from 10% to 60%.

6. The pressure regulation apparatus according to claim 1, wherein said elastic bag is made of a polymer with a yield strength ranged from 5600 to 6400 $kg/cm^2$.

7. The pressure regulation apparatus according to claim 1, wherein said filter is made of polymers of polypropylene and polythene.

8. The pressure regulation apparatus according to claim 1, wherein said filter has a density ranged from 0.01 to 0.8 $g/cm^3$.

9. The pressure regulation apparatus according to claim 1, wherein said flowing channel has an end corresponding to said positioning hole and communicating with an aperture on a cover board covering completely said flowing channel, thereby said ambient air outside said ink reservoir passing by said aperture to said filter, and entering said interior of said ink reservoir.

10. The pressure regulation apparatus according to claim 1, wherein said ink reservoir has a print head using a thermal bubble system for ejecting said ink, and a printing chip mounted thereunder.

11. A pressure regulation apparatus for an ink reservoir having a printing chip mounted thereunder and an interior for holding an ink, comprising:

an elastic bag provided in said ink reservoir and having an interior in communication with an ambient air of an ambient environment outside said ink reservoir through an opening orifice mounted on a cover body of said ink reservoir so that said ambient air outside said ink reservoir freely passes in and out said bag;

a porous filter for entering said ambient air outside said ink reservoir into said interior of said ink reservoir therethrough, wherein said porous filter is made of a material having plural fibers aligned in an axial direction; and a flowing channel formed between said porous filter and said ambient air outside said ink reservoir for passing by and entering said ambient air outside said ink reservoir into said interior of said ink reservoir through said porous filter and holding said ink therein temporarily, thereby said elastic bag and said porous filter complementarily regulating a pressure difference between said interior of said ink reservoir and said ambient environment outside said ink reservoir.

* * * * *